US010017319B1

(12) United States Patent
Moelgaard et al.

(10) Patent No.: US 10,017,319 B1
(45) Date of Patent: Jul. 10, 2018

(54) LOTTERY TICKET DISPENSING BIN WITH A RETARDING TORQUE DRIVE SYSTEM TO PREVENT TICKET REELING

(71) Applicant: Scientific Games International, Inc., Newark, DE (US)

(72) Inventors: Henrik Moelgaard, Sønderborg (DK); Sten Hallundbaek Mejenborg, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 27 days.

(21) Appl. No.: 15/394,195

(22) Filed: Dec. 29, 2016

(51) Int. Cl.

| | |
|---|---|
| ***G07B 5/02*** | (2006.01) |
| ***B65D 83/08*** | (2006.01) |
| ***B65D 83/12*** | (2006.01) |
| *G07F 17/32* | (2006.01) |

(52) U.S. Cl.
CPC ..... *B65D 83/0841* (2013.01); *B65D 83/12* (2013.01); *G07B 5/02* (2013.01); *G07F 17/329* (2013.01)

(58) Field of Classification Search
CPC ..... G07F 17/329; G07F 11/002; G07F 11/68; G07F 17/42; G07B 3/02; G07B 3/04; G07B 5/02; G07B 3/00
See application file for complete search history.

(56) References Cited

U.S. PATENT DOCUMENTS

| | | | | |
|---|---|---|---|---|
| 4,272,001 | A | 6/1981 | Horniak | |
| 5,803,308 | A * | 9/1998 | Rong | G07B 5/06 221/255 |
| 6,053,358 | A * | 4/2000 | Tong | B65H 29/12 221/151 |
| 6,428,226 | B1 * | 8/2002 | Suzuki | B41J 13/106 400/642 |
| 9,685,026 | B1 * | 6/2017 | Garrison | G07F 11/007 |
| 2005/0056675 | A1 * | 3/2005 | Bartolone | G07B 3/00 225/2 |
| 2007/0194114 | A1 * | 8/2007 | Montagutelli | G07B 5/00 235/384 |

FOREIGN PATENT DOCUMENTS

| | | |
|---|---|---|
| WO | WO 94/20908 | 9/1994 |

* cited by examiner

*Primary Examiner* — Timothy R Waggoner
(74) *Attorney, Agent, or Firm* — Dority & Manning, P.A.

(57) ABSTRACT

A lottery ticket dispenser bin includes a housing for receipt of a supply of interconnected lottery tickets. An electronic drive mechanism in the housing moves the tickets in a forward and reverse direction. A scanner is disposed within the housing at a location to detect a forward edge of a leading lottery ticket in the housing. A controller is in communication with the scanner and the electronic drive mechanism and controls the drive mechanism so that subsequent to the leading lottery ticket being dispensed out the slot, power is supplied to drive mechanism to generate a retarding reverse direction torque by a drive roller on an adjacent lottery ticket for a predetermined time period without reversing direction of the drive roller.

6 Claims, 5 Drawing Sheets

LOTTERY TICKET DISPENSING BIN WITH A RETARDING TORQUE DRIVE SYSTEM TO PREVENT TICKET REELING

BACKGROUND

Instant lottery tickets (e.g., "scratch-off" lottery tickets) are sold at many types of retail locations including, stores, such as grocery stores, general merchandise stores, and the like. Various configurations of lottery ticket dispensers have been proposed in the industry for this purpose, including electronic dispensers that automatically dispense a ticket from a bin or compartment upon receipt of an electronic command signal.

The typical scratch-off lottery tickets are delivered to retail establishments in the form of an interconnected strip in a fan-fold or rolled configuration, wherein perforation lines define individual tickets. In this regard, the individual dispensing bins must be equipped with a mechanism for separating the tickets in a reliable and repeatable manner. Failure of the final ticket separation process can be costly. For example, if the dispenser does not separate a ticket exactly along the perforation, the ticket may be "unsellable" or information needed for verification can be separated from the ticket and lost.

In addition to achieving a reliable separation of the correct number of leading tickets, the dispensing bins should also prevent pulling of additional unintended or unauthorized tickets from the bin (sometimes referred to as "reeling" in the industry). Conventional electronic ticket dispensers generally use a motor-driven wheel opposed by an idler wheel, wherein the continuous strip of tickets is conveyed through the nip defined between these wheels. Ticket reeling can result, for example, from a vendor exerting an excessive pulling force on the leading ticket during the dispense cycle that exceeds the frictional engagement between the drive wheel and the ticket, or may also be the result of a fraudulent attempt to pull on a leading ticket edge in an attempt to extract unauthorized tickets from the dispenser. This issue has been addressed in the art in various ways. For example, U.S. Pat. No. 4,272,001 and WO 1994/020908 describe a ticket dispenser that utilizes a ratchet mechanism or gear to lock rotation of the internal dispenser drive wheel after a dispense cycle. U.S. Pat. No. 5,833,104 describes use of a brake wheel that engages the drive wheel and prevents rotation thereof after a dispense cycle.

The present invention is directed to an improved system and method for preventing ticket reeling in a lottery ticket dispenser

SUMMARY

Objects and advantages of the invention will be set forth in part in the following description, or may be obvious from the description, or may be learned through practice of the invention.

In accordance with aspects of the invention, a lottery ticket dispensing bin is provided for dispensing instant or other preprinted lottery tickets at a retail establishment, wherein the lottery tickets are supplied in a continuous strip with perforation lines between individual tickets. The dispensing bin may be a component within an array, wherein a plurality of such bins are interconnected to form a bin matrix. For example, an exemplary lottery ticket dispenser array may include a matrix of 3×4 separate bins. Alternatively, the array may include interconnected modules, wherein each module has two or more bins configured therein. The type of retail establishment may vary widely within the scope and spirit of the invention. For example, in certain embodiments, the retail establishments may be convenience stores, gas stations, pubs, and any other establishment that typically sells lottery tickets to the public. An array with dispensing bins in accordance with the present invention has particular usefulness for much larger retail establishments, such as "big-box" retail stores that are part of a national or other geographic chain, wherein the sale of lottery ticket sales has generally not been implemented.

A lottery ticket dispenser bin in accordance with the invention includes a housing having a front side, an opposite back side, and an internal space for receipt of the supply of the interconnected lottery tickets. A slot is defined in the back side of each bin through which the lottery tickets are dispensed from the internal space. An electronic drive mechanism is configured in the housing and includes a motor geared to a drive roller, the motor and drive roller rotatable in a forward and reverse direction. An idler roller is disposed opposite to and defines a nip with the drive roller, wherein the lottery tickets are engaged by the drive roller and conveyed through the nip. A scanner is disposed within the housing at a location to detect a forward edge of a leading lottery ticket in the housing. A controller is in communication with the scanner and the electronic drive mechanism and includes internal dispense cycle instructions that control the drive mechanism such that after the leading lottery ticket is dispensed out the slot, power is supplied to the motor to generate a retarding reverse direction torque by the drive roller on the next adjacent lottery ticket for a predetermined time period without reversing direction of the drive roller. This retarding force does not cause the drive roller to reverse direction and draw the leading ticket back into to housing, but is sufficient to increase a "holding effect" at the nip on the adjacent lottery ticket and prevent reeling of tickets by a person grasping the leading ticket (that extends out of the slot) and attempting to pull additional tickets from the housing. Thus, a brake, one-way clutch, ratchet or pawl mechanism, or other mechanical braking device is not needed with the drive mechanism of the present invention.

With certain embodiments, the amount of retarding force generated by the drive roller is constant regardless of the pulling force exerted on the leading ticket.

In certain other embodiments, the bin may include a torque sensor configured with the drive roller or gearing between the motor and the drive roller, wherein the torque sensor senses a forward direction torque on the drive roller from an attempt to pull on the leading ticket extending from the slot. The torque sensor is in communication with the controller, and the controller is configured to increase the retarding reverse direction torque as a function of the increasing forward direction torque during the predetermined time period. In other words, the controller offsets an increasing forward direction torque on the drive roller with an increasing retarding torque.

In still other embodiments, the bin may include a motion sensor configured with the drive roller or gearing between the motor and the drive roller that senses a forward direction motion of the drive roller from an attempt to pull on the leading ticket extending from the slot. The motion sensor is in communication with the controller, and the controller is configured to increase the retarding reverse direction torque upon detection of forward motion of the drive roller during the predetermined time period.

In an exemplary embodiment, upon receipt of a dispense command (for example, from an external control system configured with the bin or dispenser array), the controller is configured to drive the motor and drive wheel so that a perforation line between the leading ticket and the trailing adjacent ticket is conveyed to a position adjacent to a tear bar, wherein the leading ticket is separated from the trailing ticket by pulling the leading ticket against the tear bar. The controller is further configured to reverse direction of the drive roller to withdraw a separated forward edge of the adjacent lottery ticket a predefined distance back into the housing after the predetermined time period to a location in a scan field of the scanner. In this manner, the adjacent ticket (which is now the leading ticket) is wholly within the housing and, thus, cannot be grasped and pulled in an attempt to extract unauthorized tickets from the bin.

Further, if the separated forward edge of the adjacent lottery ticket is not detected by the scanner (indicating that the leading ticket has not been separated from the adjacent ticket), the controller is configured to drive the motor in the forward direction corresponding to the predefined distance so as to place the perforation line between the leading ticket and the adjacent ticket back to the tear bar and to again generate the retarding reverse direction torque for the predetermined time period. This process can repeat a programmed number of times until the controller registers a fault condition and disables the dispenser.

It should be appreciated that the architecture of the individual bins can vary within the scope of the invention. For example, in one embodiment, the back side of the bin includes a pivotal door that opens to the internal space for loading of the supply of lottery tickets into the bin, wherein the dispensing slot is defined in the pivotal door and the electronic drive mechanism, sensor, and controller are mounted to the pivotal door.

The present invention encompasses an array of an interconnected plurality of the bins as described herein.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Figure 1:
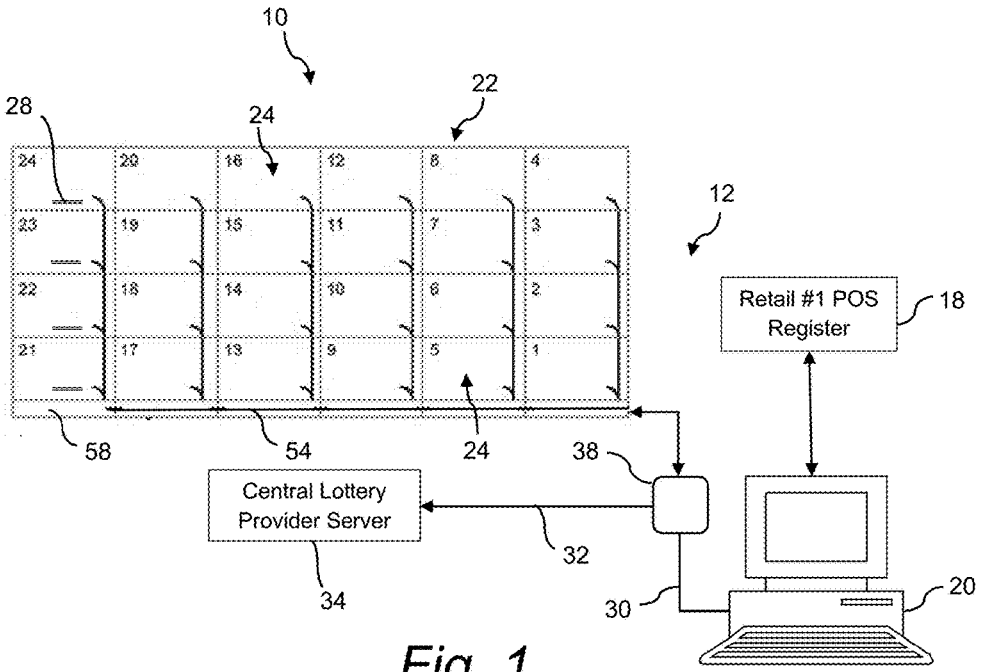
FIG. 1 is a block diagram of a lottery ticket dispenser with a plurality of dispensing bins in accordance with aspects of the present invention.

FIG. 1 depicts an embodiment of a system 10 and related methodology for dispensing lottery tickets 14 at a retail establishment 12. As mentioned above, the type of retail establishment 12 may vary widely within the scope and spirit of the invention. A retail establishment or location 12, such as a retail store, convenience store, pub, restaurant, or the like, is generally authorized by a lottery jurisdiction to carry out lottery activities, such as the sale of instant scratch-off tickets or terminal printed draw tickets for games such as Powerball™. The lottery jurisdiction may be a state lottery authority, such as the Pennsylvania Lottery, or any other governmental jurisdictional authority. A separate game provider may be partnered with the lottery jurisdiction to provide certain control, implementation, and logistical functions of the game. It should be appreciated that the type of retail establishment 12 or lottery jurisdiction entities are not limiting factors of the invention. Although not limited to such, the present system 10 has particular usefulness for larger retail establishments, such as "big-box" retail stores that are part of a national or other geographic chain.

The retail establishment 12 includes one or more retail point-of-sale (POS) registers 18 wherein patrons of the establishment 12 purchase goods. Typically, a scanner is associated with the POS register 18 to scan a UPC code on the products, with the UPC code linked to a purchase price and identification of the products, as is well-known in the art.

Figure 3:
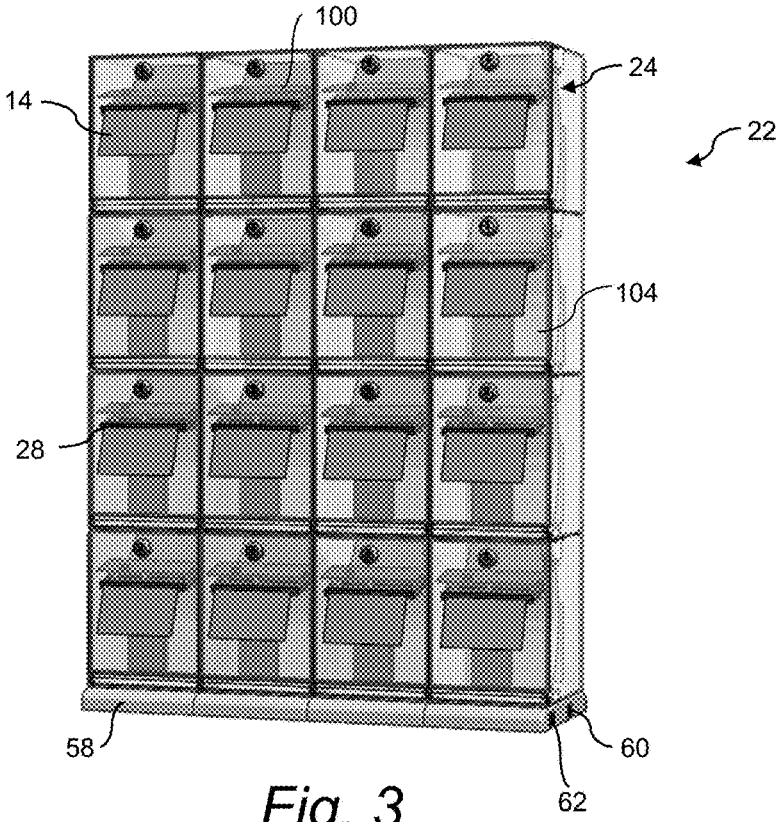
FIG. 3 is a back perspective view of an embodiment of a lottery ticket dispenser.

In the embodiment of FIG. 1, a lottery ticket terminal 20 is configured in wired or wireless communication with the retail POS register 18 to accept a request for purchase of a particular lottery ticket 14 (FIG. 3) selected from a plurality of different lottery tickets made available to patrons for purchase. This request may be input directly to the terminal 20 or come via the POS register 18. The lottery tickets 14 may be, for example, conventional instant scratch-off lottery tickets. Various types of lottery ticket terminals are known in the art and suitable for configuration with a system 10 in accordance with the invention. For example, Scientific Games Corporation having a principal place of business in Alpharetta, Ga., USA, offers Flair™ and Wave™ lottery ticket terminals that may be readily configured by those skilled in the art for a system as described herein.

A patron's request for a particular scratch-off lottery ticket may be inputted into the lottery ticket terminal 20 by a retail clerk or other employee of the retail establishment 12 by various means. For example, the terminal 20 may be configured with a scanner, wherein the clerk scans a "master" card having a code corresponding to the particular lottery ticket 14 requested by the patron. Thus, a master card or master code would be provided for each type of lottery ticket 14 offered by the establishment 12. In another embodiment, the terminal 20 may be configured with a touch-screen, keyboard, or other data input device, wherein the clerk enters or identifies the ticket 14 requested by the patron.

Still referring to the embodiment of FIG. 1, a "smart" lottery ticket dispenser array 22 is in wired or wireless communication with the terminal 20. This dispenser array includes one or a plurality of individual lottery ticket bins 24 in accordance with aspects of the present invention as described in more detail below, with each bin 24 typically containing a different respective lottery ticket game. For example, one bin 24 may contain "Lucky 7" themed scratch-off lottery tickets 14, while an adjacent bin 24 may contain "Gold Rush" themed scratch-off lottery tickets 14, and so forth.

The lottery tickets 14 are supplied to the bins 24 as a strip of interconnected tickets separated by a perforation line 16 (FIG. 7*a*) between adjacent tickets 14. The interconnected strip of tickets 14 may be in a roll form or a fan-folded stack (depicted in the drawings).

Each lottery ticket 14 in the different bins includes a machine readable code printed on a front or back side thereof, such as an alpha-numeric code, bar code, QR code, or the like. The type of code may vary depending on the desired information content of the code, space on the ticket 14, and so forth. The use of such codes on lottery tickets 14 for various functions related to inventory, identification, verification, and security are well-known. In accordance with aspects of the invention, the lottery tickets in each bin 24 are generally loaded as a fan-folded stack or roll of sequentially numbered tickets, wherein the machine readable code on each lottery ticket 14 contains the ticket number (as well as any manner of additional ticket information), for example in the form of a serial number embedded in the code.

Referring to the figures in general, each bin 24 in the dispenser array 22 includes an electronic drive mechanism 26 that, when activated, dispenses one or more lottery tickets 14 from the bin 24 (depending on the number of tickets requested by the patron). This drive mechanism 26 includes a motor 25 that drives a drive (friction) roller 107 and an opposed idler roller 105, wherein the tickets 14 are engaged in the nip between the drive roller 107 and an idler roller 105 such that driven rotation of the drive roller 107 causes the tickets 14 to be advanced through a dispensing slot 28 in a wall of the individual bin 24. The motor 25 has a shaft connected to a gear 109, with the gear 109 connected to the drive roller 107 through any suitable gearing arrangement 113. A tear bar or edge 103 is located adjacent to the slot 28, wherein the leading ticket dispensed out of the slot 28 is separated from the adjacent ticket by being pulled against the tear bar 103.

Each bin 24 also includes a controller 100, which may be configured as a control board with hardware and programmed instructions (permanent or writable) to carry out the various functions of the bin 24, as described in greater detail. The controller 100 is in communication with the driver mechanism 26.

The drive mechanism 26 is controlled to dispense a predetermined length of the interconnected tickets 14 such that the perforation line 16 between a trailing edge of a leading ticket and the forward edge of the adjacent ticket is brought to a position adjacent to the tear bar 103 for subsequent separation of the leading ticket from the adjacent ticket. This controlled dispensing cycle can be accomplished in various ways. For example, each bin 24 may also include a dedicated sensor 106 that detects when the perforation line 16 between adjacent tickets is adjacent the tear bar 103. This sensor is in communication with the controller 100, wherein the controller 100 stops the drive mechanism 26 when the perforation line is properly positioned for separating the lead lottery ticket, as sensed by the sensor 106. For example, the sensor 106 may be an optical sensor that detects the perforation line 16 between adjacent tickets. Alternately, the drive roller 107 or idler roller 105 may include an electrical or mechanical encoder that indirectly measures the length of a ticket 14 passing between the rollers 105, 107 as a function or rotations of the roller. In another embodiment, the controller 100 may include a timing circuit or clock (FIG. 7*a*) to control the dispense cycle as a function of run time of the motor. It should be appreciated that the drive mechanism 26 may be variously configured to perform the functions of dispensing the requisite number of tickets 14 from the individual respective bin 24 within the scope and spirit of the invention.

In the illustrated embodiments, each bin 24 also includes a scanner 40 disposed so as to read the code on the lottery tickets 14 as they are dispensed from the bin 24. The scanner 40 may be any conventional barcode reader, such as a point scanner, linear scanner, laser scanner, LED image scanner, and so forth. The tickets 14 are loaded into the bins 24 such that the code printed on each ticket passes within the detection field of the scanner 40. An integral (or separate) reader is configured with the scanner 40 to decode the scanner signal.

Figure 7A:
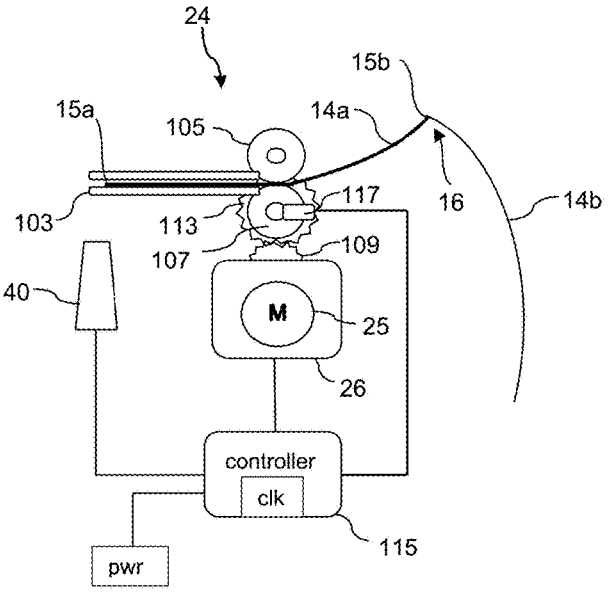
FIGS. 7*a* through 7*e* are sequential operational diagram views of a dispensing bin in accordance with aspects of the invention.

In an embodiment depicted in FIG. 7*a*, the scanner 40 also functions to detect the separated forward edge 15*a* of the lead lottery ticket 14*a*, thereby eliminating the need for a separate sensor 106.

The architecture of each bin 24 and the array 22 in general can vary within the scope of the invention. Referring to FIGS. 1 through 6, the dispenser array 22 includes a bottom row of bins 24 having interconnected base structures 58. For example, each base structure 58 may include a male power plug and male data plug along one side, and a female power port 60 and female data port 62 along the opposite side. The plugs and ports of adjacent base structures 58 interconnect to essentially define a data bus 54 (FIGS. 1 and 2) running the length of the base structures 58. An exposed power port 60 and data port 62 at one of the ends of the interconnected base structures is available for connection with a power cord and a data cord from the system control system 38 or lottery terminal 20.

Figure 5:
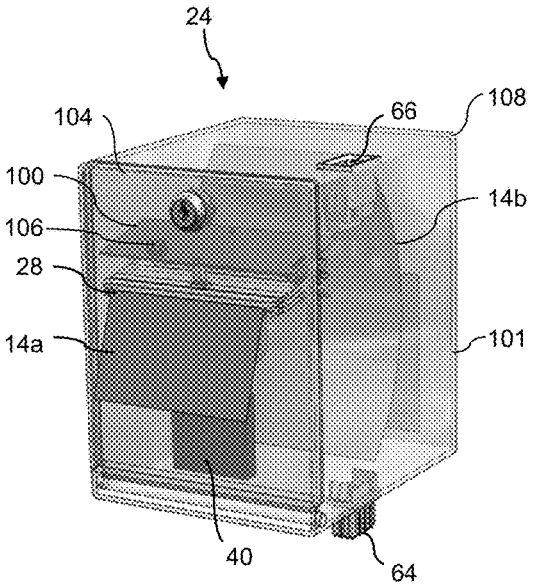
FIG. 5 is a front perspective view of a lottery ticket bin in accordance with the invention.
Figure 6:
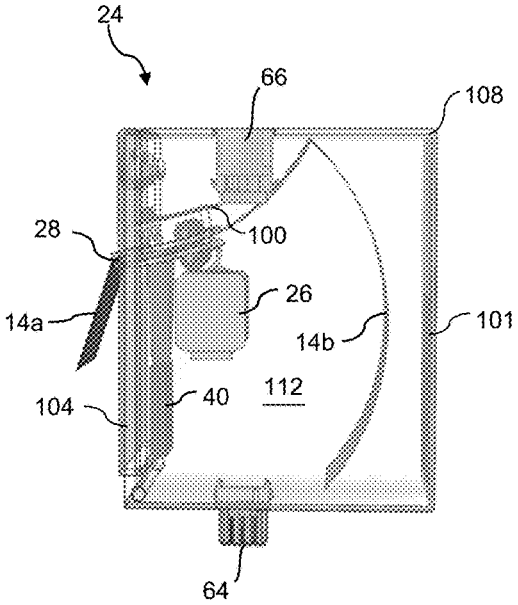
FIG. 6 is a side view of the bin embodiment of FIG. 5.

Referring to FIGS. 5 and 6 in particular, each of the individual bins 24 includes a multi-sided housing 108 defining an internal space 112 in which the stack or roll of lottery tickets 14 is stored. In the depicted embodiments, the housing 108 is a box-like member having top and bottom walls, side walls, a front wall 101, and a pivotal back wall or door 104. The back wall 104 swings open to provide access into the housing 108 for loading the ticket stack. The dispensing slot 28 may be defined in this wall 104, with the tear bars 103, 105 and respective sensors 107, 109 also mounted to the pivotal wall 104. The scanner 40, electronic drive mechanism 26, control board 100, and edge detector 106 may all be mounted on the pivotal wall 104 as well, as shown in FIGS. 5 and 6.

Figure 4:
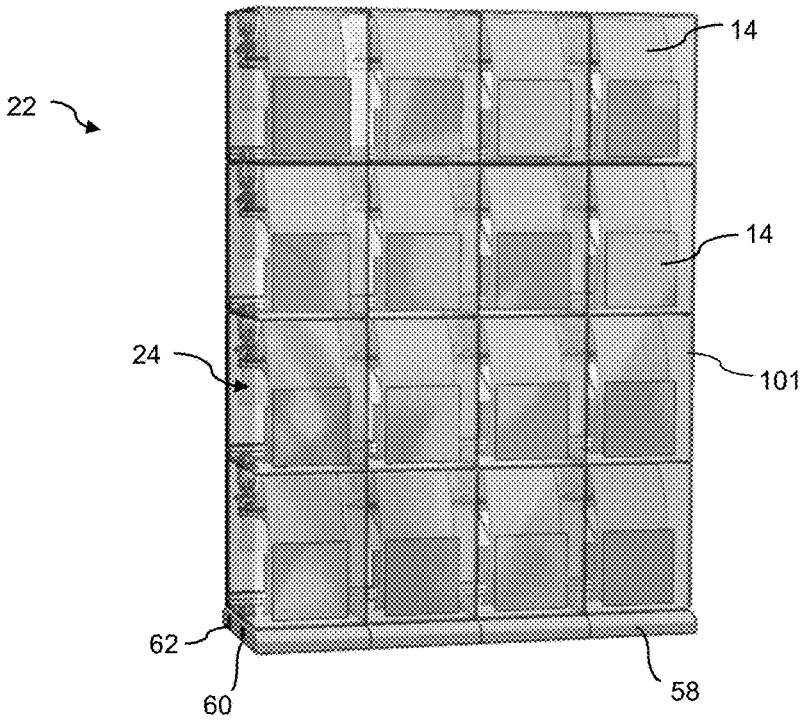
FIG. 4 is a front perspective view of the lottery ticket dispenser of FIG. 3.

As shown in FIG. 4, each bin 24 may include a sample ticket 14 or other identifying insert attached to a front face of the bin 24 that faces the patrons so that the patron is aware of the exact tickets available for purchase. Each bin 24 includes a male power/data connector 64 on the top or bottom surface, and a corresponding female power/data connector 66 on the opposite surface, as seen in FIGS. 5 and 6. With this configuration, a plurality of the bins 24 can be vertically stacked and interconnected, as depicted in the various figures.

Referring to FIGS. 7*a* through 7*e* in general, the electronic drive mechanism 26 includes the motor 25 geared to the drive roller 107, wherein the motor and drive roller are rotatable in a forward and reverse direction. The idler roller 105 is disposed opposite to the drive roller 107, wherein the lottery tickets are driven by the drive roller 107 through the nip defined with the idler roller 105. The scanner 40 is disposed at a location to detect a forward edge 15*a* of a leading lottery ticket 14*a* in the housing. The controller 115 (which may be embodied by the control board 100) is in communication with the scanner 40 and the electronic drive mechanism 26 and includes internal dispense cycle instructions that control the drive mechanism 26.

FIG. 7*a* depicts an initial static state of the bin 24 wherein the forward edge 15*a* of the leading ticket 14*a* has been withdrawn into the slot 28 after a previous dispense cycle and the bin 24 is awaiting a new dispense command.

Figure 7B:
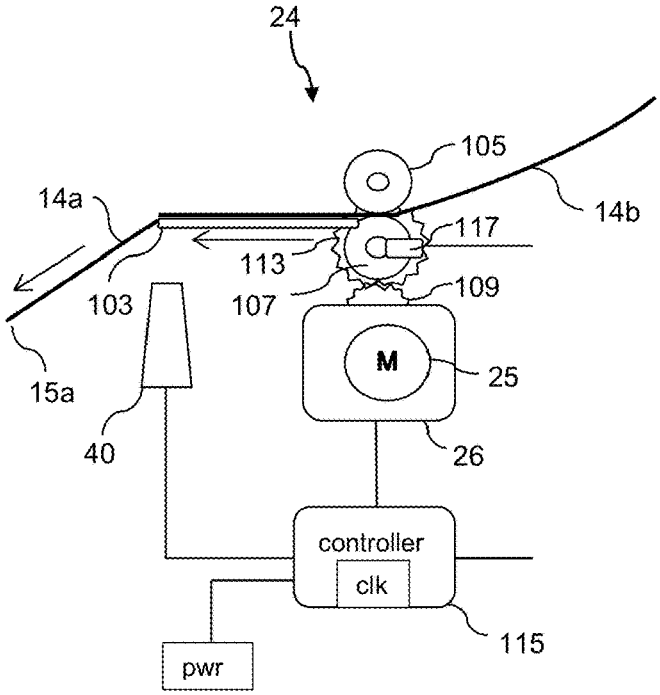

FIG. 7*b* depicts the bin 24 in operation upon receipt of a dispense command. The controller 115 controls the drive mechanism 26 to rotate the drive wheel 107 is a forward direction such that the lead ticket 14*a* is driven out of the slot 28 a predetermined length corresponding to the defined, programmed length of the ticket 14*a*. This defined length may be delivered based on a run time of the motor 25 (with an internal controller clock as depicted in the figures), or may be measured by an encoder or other device that counts revolutions of the drive roller 107.

Figure 7C:
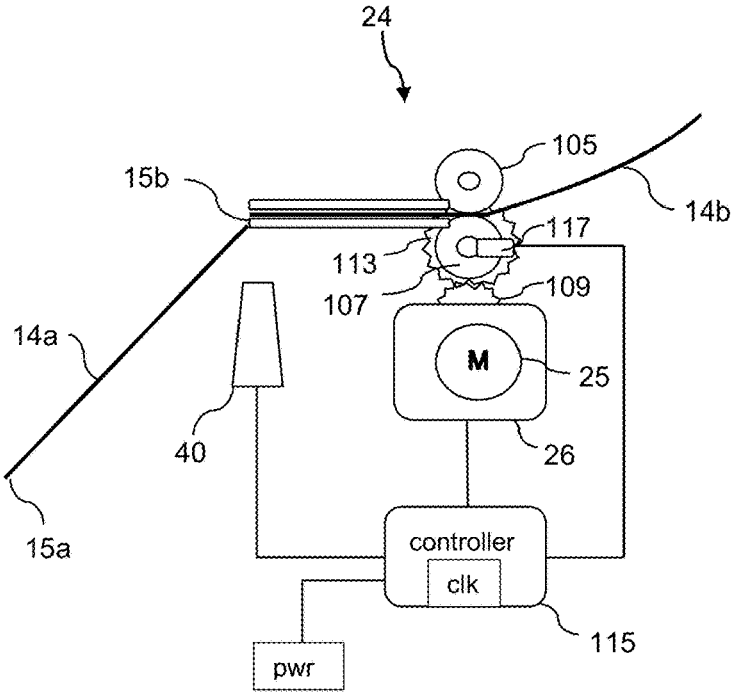

Referring to FIG. 7*c*, advancement of the lead ticket 14*a* is stopped when the perforation line 16 (FIG. 7*a*) between the lead ticket 14*a* and the adjacent, trailing ticket 14*b* is at the tear bar 103. At this time, the lead ticket 14*a* hangs out of the bin 24 and is readily grasped by a vendor and pulled against the tear bar 103 for separating the lead ticket 14*a* from the trailing ticket 14*b*. After advancement of the lead ticket 14*a* ceases, the controller 115 supplies power to the motor 25 to generate a retarding reverse direction torque by the drive roller 107 on the adjacent lottery ticket 14*b* extending through the nip for a predetermined time period of the drive roller 107. This retarding force does not cause the drive roller 107 to reverse direction and draw the lead ticket 14*a* back into to housing, but is sufficient to generate a "holding effect" at the roller nip on the adjacent lottery ticket 14*b* to prevent reeling of tickets by a person grasping the leading ticket 14*a* extending from the slot 28 and attempting to pull additional tickets from the housing. The retarding force is sustained by the controller 115 for a defined period of time (e.g. 20 secs.) sufficient to allow the vendor to complete the purchase transaction and separate the leading ticket 14*a*.

Still referring to FIG. 7*c*, the amount of retarding force generated by the drive roller may be constant regardless of the pulling force exerted on the leading ticket 14*a*. For this, the power supplied to the drive motor 25 in the reverse direction can be maintained at a constant level during the defined time period.

In other embodiments, the bin 24 may include a sensor 117 implemented as a torque sensor configured with the drive roller 107, motor shaft 25, or gearing 109 between the motor 25 and the drive roller 107, wherein the torque sensor 117 senses a forward direction torque on the drive roller 107 from an attempt to pull on the leading ticket 14*a* extending from the slot during the defined period of time when the reverse retarding force is applied. The torque sensor 117 is in communication with the controller 115, and the controller 115 is configured to increase the retarding reverse direction torque as a function of the increasing forward direction torque sensed by the torque sensor 117 during the predetermined time period. In other words, the controller 115 offsets an increasing forward direction torque on the drive roller 107 with an increasing retarding torque.

In another embodiment, the bin sensor 117 may be a motion sensor configured with the drive roller 107, motor shaft 25, or gearing 109 between the motor 25 and the drive roller 107, wherein the motion sensor 117 senses forward motion of the drive roller 107 from an attempt to pull on the leading ticket 14*a* extending from the slot during the defined period of time when the reverse retarding force is applied. The motion sensor 117 is in communication with the controller 115, and the controller 115 is configured to increase the retarding reverse direction torque as a function of the increasing forward motion sensed by the motion sensor 117 during the predetermined time period. In other words, the controller 115 offsets an increasing forward direction motion of the drive roller 107 with an increasing retarding torque.

Figure 7D:
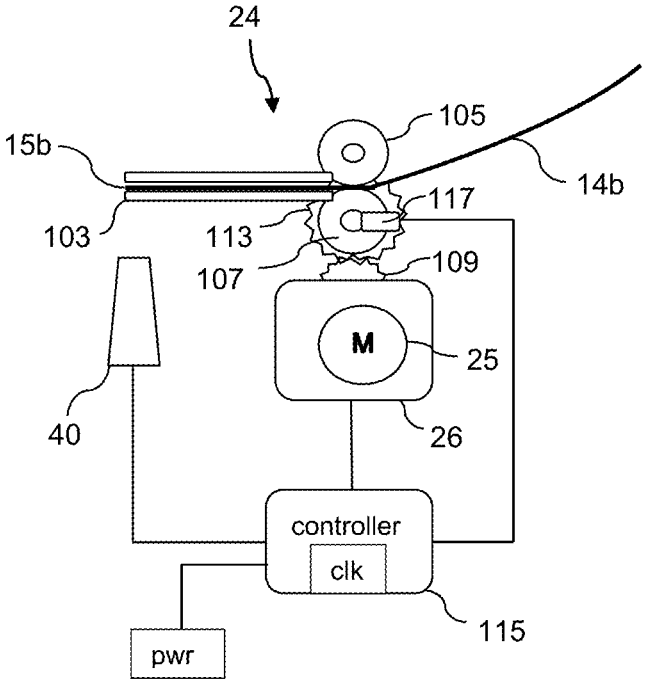
Figure 7E:
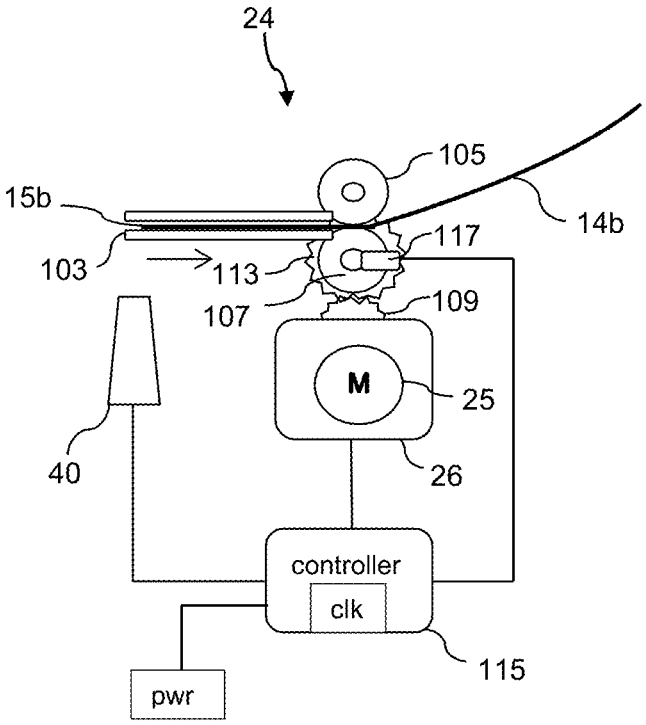

Referring to FIGS. 7*d* and 7*e*, the controller 115 is further configured to reverse direction of the drive roller 107 after the predefined time period of applying the retarding force to withdraw a separated forward edge 15*b* of the adjacent lottery ticket 14*b* a predefined distance back into the housing to a location in a scan field of the scanner 40. In this manner, the adjacent ticket 14*b* (which is now the leading ticket) is wholly within the housing and, thus, cannot be grasped and pulled in an attempt to extract unauthorized tickets from the bin 24. FIG. 7*d* depicts the bin 24 after the lead ticket 14*a* has been separated from the trailing ticket 14*b*, and FIG. 7*e* depicts the trailing ticket 14*b* being withdrawn into the bin by reverse drive of the motor 25.

Referring to FIG. 7*e*, if the separated forward edge 15*b* of the adjacent lottery ticket 14*b* is not detected by the scanner 40 (indicating that the leading ticket 14*a* has not been separated from the adjacent ticket 14*b*), the controller 115 is configured to drive the motor 25 in the forward direction corresponding to the withdrawal predefined distance so as to place the perforation line 16 (FIG. 7*a*) between the leading ticket and the adjacent ticket back to the tear bar 103. At this time, the retarding force is again generated as described above. This process may be necessary when the lead ticket 14*a* was not separated for any legitimate reason, for example, because the vendor was too busy with completing the purchase transaction during the initial time period. This process may repeat for a defined number of times (e.g., three times) before the controller takes further action, such as shutting down the particular bin 24 and generating an error message to the central control system.

Referring again to FIGS. 1 and 2, the control system 38 may be a central system that is common to (and in communication with) all of the bins 24 in the array for performing the functions discussed herein. This central control system 38 may be physically configured with the array 22 (e.g., within a base structure) or may be remote from the array 22.

Figure 2:
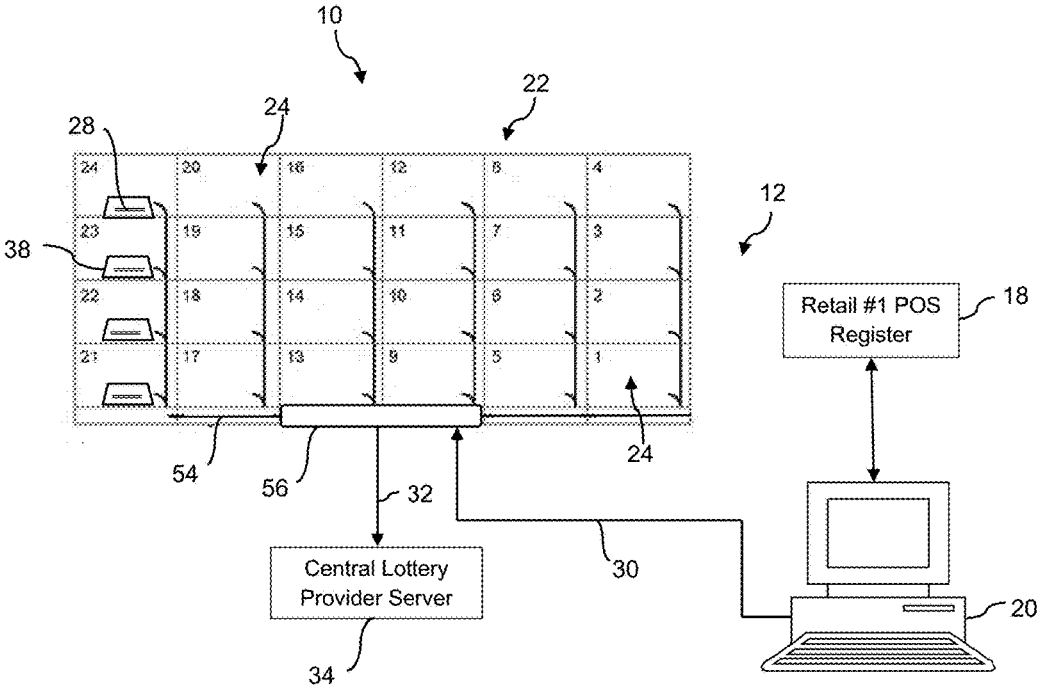
FIG. 2 is a block diagram of another embodiment of a lottery ticket dispenser with bins in accordance with aspects of the present invention.

In another embodiment, the control system 38 may be an individual system configured with each bin 24. For example, as discussed above, each bin 24 may include the control board 100 having logic circuitry to control the various components within the bin 24, such as the scanner 40, leading edge sensor 106, electronic drive mechanism 26, and so forth. Any manner of control or power components can be mounted on the board 100 for operation of the individual bins 24 as described herein. FIG. 2 depicts individual control systems 38 for each bin 24 in direct communication with the terminal 20 via a signal router 56 integrated with the dispenser array 22. This router 56 routes the purchase signal 30 from the lottery ticket terminal 20 to the correct bin 24.

Referring to the system of FIGS. 1 and 2, the lottery ticket terminal 20 transmits a purchase signal 30 for dispensing a particular lottery ticket 14 that is routed to the respective bin 24 within the dispenser array 22 containing the requested lottery ticket. This purchase signal 30 may be sent to an individual control system 38 associated with the bin 24 (FIG. 2), or to a common control system 38 associated with all of the bins 24 (FIG. 1), to activate the drive mechanism 26 and dispense the requisite number of lottery tickets 14 from the bin 24. Signals from the tear bar sensors 107, 109 are received by the control system 38 (individual system or common system).

In an alternate embodiment, the purchase signal 30 is generated by the POS register 18 and transmitted to the control system 38 after the POS register 18 receives a purchase code from the lottery ticket terminal 20 corresponding to the particular ticket requested by the patron.

The system 10 may include a central lottery server 34 that is common to a number of different retail establishments 12. As described above, as the tickets 14 are dispensed from the bin 24, the scanner 40 reads the code printed on each ticket or, alternatively, the first and last codes printed on sequentially dispensed tickets, and the tear bar sensors 107, 109 detect a ticket separation cycle. A signal 32 form the control system 38 containing the scanned code and tear bar sensor data may be routed to the central lottery server 34 for each lottery ticket dispensed from the dispenser array 22 to enable certain actions relevant to the sale, dispensing, verification, accounting of the individual tickets 14. For example, the central lottery server 34 may include a database of all tickets delivered to the respective retail establishments 12, and the near instantaneous identification of dispensed/sold lottery tickets 14 to the server 34 enables various desired functionalities. For example, the individual lottery tickets 14 may remain "inactive" in the lottery provider's system (and thus unable to be redeemed) until individually activated by the central lottery server 34 as they are dispensed and sold. Thus, fraudulently obtained tickets (e.g., stolen or otherwise illegally obtained) cannot be redeemed. This is contrary to a conventional practice of activating entire books ("packs") of tickets upon delivery to a retail establishment 12.

The present system also 10 allows for enhanced accountability of lottery tickets 14 sold at a particular retail establishment 12 by logging each ticket as it is sold and dispensed. The number of tickets 14 sold during a work shift (or other time period) is easily determined by generating a report by the central server 34 of the tickets sold at any of the retail establishments during any defined time period. The number of tickets 14 sold at any of the retail establishments 12 can be readily reconciled with tickets delivered to the establishment. Likewise, the number of tickets 14 dispensed during a defined time can be readily and electronically reconciled with reported purchase transactions from the respective establishment 12, with discrepancies being immediately identified for further investigation.

Another particular advantage of the system 10 and associated method is that billing practices between the retail establishments 12 and lottery authority, the lottery service provider, or ticket manufacturer can be based on real-time sales of the lottery tickets 14. For example, the retail establishments 12 can be invoiced on a periodic basis (e.g., daily or weekly) for the actual number of tickets sold (dispensed) at each respective establishment based on the signals 32 routed to the central lottery server 34 instead of upon delivery, or other payment methodology typically in use today. These include but are not limited to consignment for a predetermined time period, or estimate of sales based on the number of winning tickets cashed from a pack of tickets being sold.

It should be appreciated that the terms "server" is used herein to encompass any configuration of computer hardware and software that is maintained by a lottery authority or game provider to carry out the functionalities of the present system 10 and associated method, as well as any manner of additional lottery functions known to those skilled in the art. It should be readily appreciated that the server 34 may include an integrated server, or any manner of periphery server or other hardware structure. The central lottery server 34 is typically remote from the retail establishments 12, and is in communication with the establishments 12 via a suitable secure communication network, which may include any manner of wide area network, wireless internet, or cloud computing. The server 34 may be a single networked computer, or a series of interconnected computers having access to the communications network via a gateway or other known networking system. Generally, the server 34 is configured to communicate with, manage, execute and control individual lottery terminal units 20 within the lottery jurisdiction. The server 34 may be a "front end" server provided by the lottery game provider that is interfaced with the existing draw/instant game system infrastructure one or more separate lottery authorities. The server 34 may include a memory for storing gaming procedures and routines, a microprocessor (MP) for executing the stored programs, a random access memory (RAM) and an input/output (I/O) bus. These devices may be multiplexed together via a common bus, or may each be directly connected via dedicated communications lines, depending on the needs of the system 10.

The server 34 may be directly or indirectly connected through an I/O bus to any manner of peripheral devices such as storage devices, wireless adaptors, printers, and the like. In addition, a database (DB) may be communicatively connected to the server 34 and provide a data repository for the storage and correlation of information gathered from the individual dispenser arrays 22, such as the identity of each lottery ticket 14 dispensed from the array, the time of the dispense sequence, confirmation of ticket activation, and so forth.

It should be appreciated that embodiments of the methods and systems 10 disclosed herein may be executed by one or more suitable networked lottery gaming components and establishment components (e.g., POS register 18, back office server, and so forth) within a plurality of the establishments 12, as well as the remote central server 34. Such gaming systems and computing devices may access one or more computer-readable media that embody computer-readable instructions which, when executed by at least one computer, cause the computer(s) to implement one or more embodiments of the methods of the present subject matter. Additionally or alternatively, the computing device(s) may comprise circuitry that renders the device(s) operative to implement one or more of the methods of the present subject matter. Furthermore, components of the presently-disclosed technology may be implemented using one or more computer-readable media.

As mentioned above, aspects of the present system 10 and methods rely on the transmission of data over one or more communications networks. It should be appreciated that network communications can comprise sending and/or receiving information over one or more networks of various forms. For example, a network can comprise a dial-in, public switched telephone network (PSTN), a local area network (LAN), wide area network (WAN), the Internet, an intranet or other type of network. A network may comprise any number and/or combination of hard-wired, wireless, or other communication links.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A lottery ticket dispenser bin to dispense a continuous strip of lottery tickets interconnected by perforation lines, comprising:

a housing having a front side, an opposite back side, and an internal space for receipt of a supply of the interconnected lottery tickets;

a slot defined in the back side of each bin through which the lottery tickets are dispensed from the internal space;

an electronic drive mechanism configured in the housing, the electronic drive mechanism further comprising:

a motor geared to a drive roller, the motor and drive roller rotatable in a forward and reverse direction;

an idler roller disposed opposite to and defining a nip with the drive roller, wherein the lottery tickets are engaged by the drive roller and conveyed through the nip;

a scanner disposed within the housing at a location to detect a forward edge of a leading lottery ticket in the housing; and a controller in communication with the scanner and the electronic drive mechanism, the controller comprising dispense cycle instructions that control the drive mechanism so that subsequent to the leading lottery ticket being dispensed out the slot, power is supplied to the motor to generate a retarding reverse direction torque by the drive roller on an adjacent lottery ticket for a predetermined time period without reversing direction of the drive roller.

2. The lottery ticket dispenser bin as in claim 1, further comprising a torque sensor configured with the drive roller or gearing between the motor and the drive roller that senses a forward direction torque on the drive roller from an attempt to pull on the leading ticket extending from the slot, the torque sensor in communication with the controller, and the controller configured to increase the retarding reverse direction torque as a function of increasing forward direction torque during the predetermined time period.

3. The lottery ticket dispenser bin as in claim 1, further comprising a motion sensor configured with the drive roller or gearing between the motor and the drive roller that senses a forward direction motion of the drive roller from an attempt to pull on the leading ticket extending from the slot, the motion sensor in communication with the controller, and the controller configured to increase the retarding reverse direction torque upon detection of forward motion of the drive roller during the predetermined time period.

4. The lottery ticket dispenser bin as in claim 1, wherein upon receipt of a dispense command, the controller is further configured to drive the motor and drive wheel so that a perforation line between the leading ticket and the adjacent ticket is conveyed to adjacent a tear bar, the controller further configured to reverse direction of the drive roller to withdraw a separated forward edge of the adjacent lottery ticket a predefined distance back into the housing after the predetermined time period to a location in a scan field of the scanner.

5. The lottery ticket dispenser bin as in claim 4, wherein if the separated forward edge of the adjacent lottery ticket is not detected by the scanner, the controller is configured to drive the motor in the forward direction corresponding to the predefined distance so as to place the perforation line between the leading ticket and the adjacent ticket back to the tear bar and to again generate the retarding reverse direction torque for the predetermined time period.

6. The lottery ticket dispenser bin as in claim 1, wherein the back side of the bin comprises a pivotal door that opens to the internal space for loading of the supply of lottery tickets into the bin, the slot defined in the pivotal door, and wherein the electronic drive mechanism, sensor, and controller are mounted to the pivotal door.

* * * * *